US011322868B2

(12) United States Patent
Huang et al.

(10) Patent No.: US 11,322,868 B2
(45) Date of Patent: May 3, 2022

(54) ELECTRICAL CONNECTOR ASSEMBLY WITH LOCKABLE STRUCTURES

(71) Applicant: DONGGUAN LUXSHARE TECHNOLOGIES CO., LTD, Dongguan (CN)

(72) Inventors: Bin Huang, Shenzhen (CN); Tiesheng Li, Shenzhen (CN); Hongji Chen, Shenzhen (CN); Kun Liu, Shenzhen (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/036,413

(22) Filed: Sep. 29, 2020

(65) Prior Publication Data

US 2021/0013644 A1 Jan. 14, 2021

Related U.S. Application Data

(63) Continuation of application No. 16/397,406, filed on Apr. 29, 2019, now Pat. No. 10,833,437.

(30) Foreign Application Priority Data

May 30, 2018 (CN) ..... 201820826642.0

(51) Int. Cl.

| | |
|---|---|
| ***H01R 12/70*** | (2011.01) |
| ***H01R 12/58*** | (2011.01) |
| ***H01R 12/79*** | (2011.01) |
| ***H01R 13/24*** | (2006.01) |

(52) U.S. Cl.
CPC ..... *H01R 12/7023* (2013.01); *H01R 12/58* (2013.01); *H01R 12/79* (2013.01); *H01R 13/2428* (2013.01)

(58) Field of Classification Search
CPC ..... H01R 12/7023
See application file for complete search history.

(56) References Cited

U.S. PATENT DOCUMENTS

| | | | |
|---|---|---|---|
| 6,821,139 | B1 | 11/2004 | Wu |
| 6,926,553 | B2 | 8/2005 | Wu |
| 7,114,980 | B1 | 10/2006 | Wu |

(Continued)

FOREIGN PATENT DOCUMENTS

| | | | |
|---|---|---|---|
| CN | 208738551 | U | 4/2019 |

*Primary Examiner* — Ross N Gushi
(74) *Attorney, Agent, or Firm* — Birch, Stewart, Kolasch & Birch, LLP

(57) ABSTRACT

An electrical connector assembly includes a board end connector and a wire end connector. The board end connector includes a board end connector shell and a board end connector body. The wire end connector includes a wire end case and a tongue plate. At least one guide piece is extended from one of the board end connector shell and the wire end case, and a remaining one of the board end connector shell and the wire end case is provided with at least one guide slot for creating a butt joint with the guide piece. The electrical connector assembly of the present disclosure utilizes the space of the board end to the maximum extent, solves the problem that the CPU occupies the space of the board end due to the increased size of the heat dissipation module, and can realize high-speed data transmission.

24 Claims, 7 Drawing Sheets

(56) References Cited

U.S. PATENT DOCUMENTS 7,134,914 B1 11/2006 Wu
7,160,135 B1 1/2007 Wu
7,175,444 B2 2/2007 Lang et al.
7,189,098 B1 3/2007 Wu
7,226,314 B2 6/2007 Lang et al.
7,226,316 B2 6/2007 Wu
7,232,329 B1 6/2007 Wu
7,238,040 B1 7/2007 Wu
7,261,582 B2 8/2007 Wu
7,267,575 B1 9/2007 Hwang
7,281,937 B2 10/2007 Reed et al.
7,281,938 B1 10/2007 Wu
7,291,034 B2 11/2007 Wu
7,303,438 B2 12/2007 Dawiedczyk et al.
7,331,822 B2 2/2008 Chen
7,344,409 B2 3/2008 Lang et al.
7,410,365 B2 8/2008 Wu
7,413,461 B2 8/2008 Dawiedczyk et al.
7,445,502 B2 11/2008 Zhang
7,445,503 B1 11/2008 Zhang
7,445,504 B1 11/2008 Zhang
7,448,897 B2 11/2008 Dawiedczyk et al.
7,473,124 B1 1/2009 Briant et al.
7,491,089 B2 2/2009 Lang et al.
7,540,755 B1 6/2009 Wu
7,559,800 B2 7/2009 Wu
7,572,138 B1 8/2009 Wu
7,601,010 B1 10/2009 Wu
7,651,342 B1 1/2010 Wu
7,654,831 B1 2/2010 Wu
7,666,023 B2 2/2010 Wu
7,686,622 B2 3/2010 Dawiedczyk et al.
7,798,821 B2 9/2010 Liu et al.
7,803,010 B1 9/2010 Hwang
7,857,650 B1 12/2010 Wu
7,891,986 B2 2/2011 Wu
7,909,661 B2 3/2011 Wu
7,938,669 B2 5/2011 Li et al.
7,997,909 B2 8/2011 Xu et al.
7,997,922 B2 8/2011 Dawiedczyk et al.
8,152,568 B2 4/2012 Wu
8,162,687 B2 4/2012 Dawiedczyk et al.
RE43,427 E 5/2012 Dawiedczyk et al.
8,241,045 B2 8/2012 Reed et al.
8,251,735 B2 8/2012 Wu
8,267,713 B2 9/2012 Wu
8,292,637 B2 10/2012 Wu
8,303,325 B2 11/2012 Yang
8,337,233 B2 12/2012 Wu
8,342,881 B2 1/2013 Lang et al.
8,360,799 B2 1/2013 Wu
8,382,506 B2 2/2013 Reed et al.
8,393,913 B2 3/2013 Wu
8,439,704 B2 5/2013 Reed
8,439,706 B2 5/2013 Sytsma et al.
8,449,312 B2 5/2013 Lang et al.
8,454,381 B2 6/2013 Wu
8,475,197 B2 7/2013 Zerebilov et al.
8,475,198 B2 7/2013 Wu
8,475,199 B2 7/2013 Wang et al.
8,480,432 B2 7/2013 Wu
8,506,331 B2 8/2013 Wu
8,523,598 B2 9/2013 Wu
8,537,558 B2 9/2013 Su et al.
8,550,848 B2 10/2013 Wu
8,668,515 B2 3/2014 Wu
8,708,752 B2 4/2014 Wu
8,740,637 B2 6/2014 Wang et al.
8,770,990 B2 7/2014 Sytsma et al.
8,851,906 B2 10/2014 Wu et al.
8,858,240 B2 10/2014 Wu et al.
8,905,777 B2 12/2014 Zhu et al.
8,926,339 B2 1/2015 Houtz
8,979,553 B2 3/2015 Lloyd et al.
9,017,091 B2 4/2015 Zhu et al.
9,160,106 B2 10/2015 Kuang et al.
9,293,839 B2 3/2016 Nagamine
9,331,418 B2 5/2016 Chung
9,385,450 B2 7/2016 Wu et al.
9,385,466 B2 7/2016 Henry et al.
9,385,472 B2 7/2016 Yen
9,419,367 B2 8/2016 Henry et al.
9,553,394 B2 1/2017 Lee et al.
9,728,871 B1 * 8/2017 Gutgold ..... H01R 13/6275
9,742,132 B1 8/2017 Hsueh
9,774,146 B2 9/2017 Cheng et al.
10,084,271 B2 9/2018 Xing et al.
10,096,944 B2 10/2018 Huang et al.
10,205,256 B2 * 2/2019 Wu ..... H01R 12/7005
10,236,605 B1 * 3/2019 Henry ..... H01R 12/732
10,263,349 B2 4/2019 Philips et al.
10,270,191 B1 4/2019 Li et al.
10,381,783 B2 * 8/2019 Zhou ..... H01R 43/24
10,431,932 B1 10/2019 Zhang et al.
10,431,935 B2 10/2019 Huang et al.
2005/0026500 A1 2/2005 Ji et al.
2006/0019525 A1 1/2006 Lloyd et al.
2006/0134993 A1 6/2006 Dawiedczyk et al.
2006/0160399 A1 7/2006 Dawiedczyk et al.
2006/0160429 A1 7/2006 Dawiedczyk et al.
2006/0189180 A1 8/2006 Lang et al.
2006/0189199 A1 8/2006 Lang et al.
2006/0189211 A1 8/2006 Lang et al.
2007/0105410 A1 5/2007 Wu
2007/0111598 A1 * 5/2007 Quilici ..... H01R 13/6594
439/595
2007/0155217 A1 7/2007 Wu
2007/0155218 A1 7/2007 Wu
2007/0161281 A1 7/2007 Wu
2007/0173118 A1 7/2007 Chen
2008/0020640 A1 1/2008 Zhang
2008/0032541 A1 2/2008 Reed et al.
2008/0085633 A1 4/2008 Dawiedczyk et al.
2008/0166899 A1 7/2008 Lang et al.
2008/0194136 A1 8/2008 Aihara
2009/0124124 A1 5/2009 Huang et al.
2009/0197438 A1 8/2009 Liu et al.
2009/0247017 A1 10/2009 Wu
2009/0253292 A1 10/2009 Wu
2010/0015851 A1 1/2010 Wu
2010/0091466 A1 4/2010 Wu
2010/0091467 A1 4/2010 Wu
2010/0130063 A1 5/2010 Lang et al.
2010/0203754 A1 8/2010 Li et al.
2010/0210131 A1 8/2010 Reed et al.
2010/0248544 A1 9/2010 Xu et al.
2011/0045702 A1 2/2011 Su et al.
2011/0059645 A1 3/2011 Wu
2011/0086548 A1 4/2011 Wu
2011/0136368 A1 6/2011 Wu
2011/0195586 A1 8/2011 Wu
2011/0195590 A1 8/2011 Wu
2011/0195595 A1 8/2011 Wu
2011/0195614 A1 8/2011 Wu
2011/0237112 A1 9/2011 Wu
2011/0250778 A1 10/2011 Wu
2011/0281455 A1 11/2011 Wu
2011/0294333 A1 12/2011 Wu
2011/0300735 A1 12/2011 Wu
2011/0300749 A1 12/2011 Sytsma et al.
2011/0306228 A1 12/2011 Wu
2011/0306244 A1 12/2011 Zhang et al.
2012/0015544 A1 1/2012 Wu
2012/0015545 A1 1/2012 Wu
2012/0040550 A1 2/2012 Wu
2012/0040552 A1 2/2012 Wu
2012/0064750 A1 3/2012 Wu
2012/0064779 A1 3/2012 Wu
2012/0129396 A1 5/2012 Wang et al.
2012/0156900 A1 6/2012 Wu
2012/0156938 A1 6/2012 Zhang
2012/0171903 A1 7/2012 Wang et al.
2012/0184126 A1 7/2012 Chen et al.
2012/0214324 A1 8/2012 Wu

(56) References Cited

U.S. PATENT DOCUMENTS

| | | | | |
|---|---|---|---|---|
| 2012/0214345 | A1 | 8/2012 | Wu | |
| 2013/0095676 | A1 | 4/2013 | Wu | |
| 2013/0203293 | A1 | 8/2013 | Zhu et al. | |
| 2014/0322933 | A1 | 10/2014 | Li et al. | |
| 2015/0011103 | A1* | 1/2015 | Yu | H01R 13/502 439/64 |
| 2016/0064873 | A1 | 3/2016 | Bucher et al. | |
| 2018/0145448 | A1 | 5/2018 | Munch | |
| 2018/0212364 | A1 | 7/2018 | Huang et al. | |
| 2018/0269607 | A1 | 9/2018 | Wu et al. | |
| 2018/0366875 | A1 | 12/2018 | Shinder-Lerner et al. | |
| 2019/0074616 | A1 | 3/2019 | Hou et al. | |
| 2019/0296495 | A1 | 9/2019 | Zhou et al. | |

* cited by examiner

ELECTRICAL CONNECTOR ASSEMBLY WITH LOCKABLE STRUCTURES

CROSS-REFERENCE TO RELATED APPLICATIONS

This application is a continuation of U.S. patent application Ser. No. 16/397,406, filed Apr. 29, 2019, which is in condition for allowance and claims priority under 35 U.S.C. § 119(a) on Patent Application No. 201820826642.0 filed in P.R. China on May 30, 2018, the entire contents of which are hereby incorporated by reference.

Some references, if any, which may include patents, patent applications and various publications, may be cited and discussed in the description of this invention. The citation and/or discussion of such references, if any, is provided merely to clarify the description of the present disclosure and is not an admission that any such reference is "prior art" to the invention described herein. All references listed, cited and/or discussed in this specification are incorporated herein by reference in their entireties and to the same extent as if each reference was individually incorporated by reference.

TECHNICAL FIELD

The present disclosure relates to a connector assembly, in particular to an electrical connector assembly with lockable structures.

BACKGROUND

With the increase of the network age, the requirements on data processing and transmission speed are increased, the performance and device density of the corresponding servers, workstations and CPUs in the I/O memory are synchronously improved, and certain challenges are brought to the device size and the heat dissipation of the servers. Generally, the heat sink occupies a large space on the printed circuit board, and the space between the heat sink and the printed circuit board in the height direction is small, such that the conventional connector cannot be arranged below the heat sink, and it is difficult to utilize the redundant space below the heat sink, resulting in wasted space of the printed circuit board is wasted.

SUMMARY

The present disclosure provides a high-speed connector on a high-density MINI version chip side, which has small size and the height of less than 3.7 mm, can be placed under a heat sink of a chip, and has the transmission speed up to 56 Gbit/s. The space of the board end is utilized to the maximum extent, and the problem that the CPU occupies the space of the board end due to the size expansion of the radiating module is solved.

To achieve the above object, the present disclosure provides a high-speed connector on a high-density MINI version chip side, comprising: a board end connector, a wire end connector and a printed circuit board; the board end connector is arranged on the printed circuit board; the board end connector comprises a board end connector shell and a board end connector body arranged in the board end connector shell; the wire end connector comprises a wire end case and a tongue plate fixed to the wire end case; wherein at least one guide piece extends from the board end connector shell, and the wire end case is provided with at least one guide slot for creating a butt joint with the guide piece.

The present disclosure also provides a printed circuit board layout structure, comprising: a connector, a chip and a heat sink arranged on the chip, the connector is arranged below the heat sink, the connector comprises: a board end connector, a wire end connector and a printed circuit board; the board end connector is arranged on the printed circuit board; the board end connector comprises a board end connector shell and a board end connector body arranged in the hoard end connector shell; the wire end connector comprises a wire end case and a tongue plate fixed to the wire end case; wherein at least one guide piece extends from the board end connector shell, and the wire end case is provided with at least one guide slot for creating a butt joint with the guide piece.

The beneficial effects of the present disclosure are: the space of the board end is utilized to the maximum extent, the problem that the CPU occupies the space of the board end due to the increased size of the heat dissipation module is solved, and high-speed data transmission can be realized.

The present disclosure will be described in detail below with reference to the following drawings and embodiments, but the present disclosure is not limited thereto.

LIST OF THE REFERENCE NUMERALS

Figure 1:
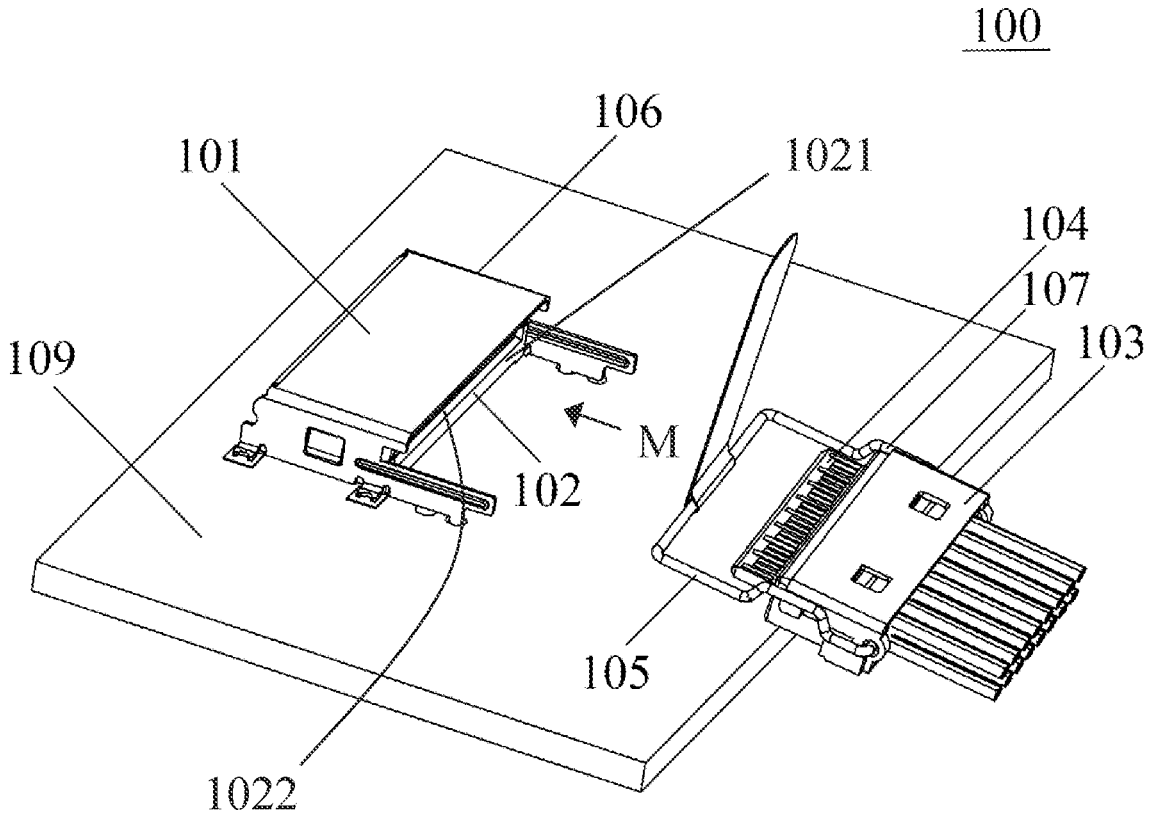
FIG. 1 is a perspective view of an electrical connector assembly of the present disclosure in a separated state.

100 Connector
101 Board end connector shell
102 Board end connector body
103 Wire end case
104 Tongue plate
105 Lockable snap
106 Board end connector
107 Wire end connector
109 Printed circuit board
110 Guide piece
111 Guide projection
112 Guide slot
113 Welding foot
114 Snap protrusion

115 Slot
116 Step
117 Conductive terminal
118 Conductive plastic

DETAILED DESCRIPTION OF THE EXEMPLARY EMBODIMENTS

The structural principle and the operational principle of the present disclosure will be described in detail below with reference to the attached drawings:

FIG. 1 is a perspective view showing an electrical connector assembly 100 of the present disclosure in separated state. As shown in FIG. 1, the electrical connector assembly 100 is a high-speed electrical connector assembly on high density MINI version chip side of the present disclosure. The electrical connector assembly includes a first connector such as a hoard end connector 106, a second connector such as a wire end connector 107 and a printed circuit board 109. Both of the board end connector 106 and the wire end connector 107 are used cooperatively.

The board end connector 106 is mounted on the printed circuit board 109 and comprises a board end connector shell 101 and a board end connector body 102 embedded in the board end connector shell 101. Referring to FIG. 1, the board end connector 106 includes an insertion surface 1021 and a receiving slot 1022 extending through the insertion surface 1021 to receive the wire end connector 107 along a mating direction M.

The wire end connector 107 comprises a wire end case 103, a tongue plate 104, a wire end body (not shown) and a lockable snap 105. The tongue plate 104 is covered by the wire end body, the wire end case 103 covers the wire end body and is fixed to the wire end body, and the lockable snap 105 is arranged at both sides of the wire end case 103.

Figure 2:
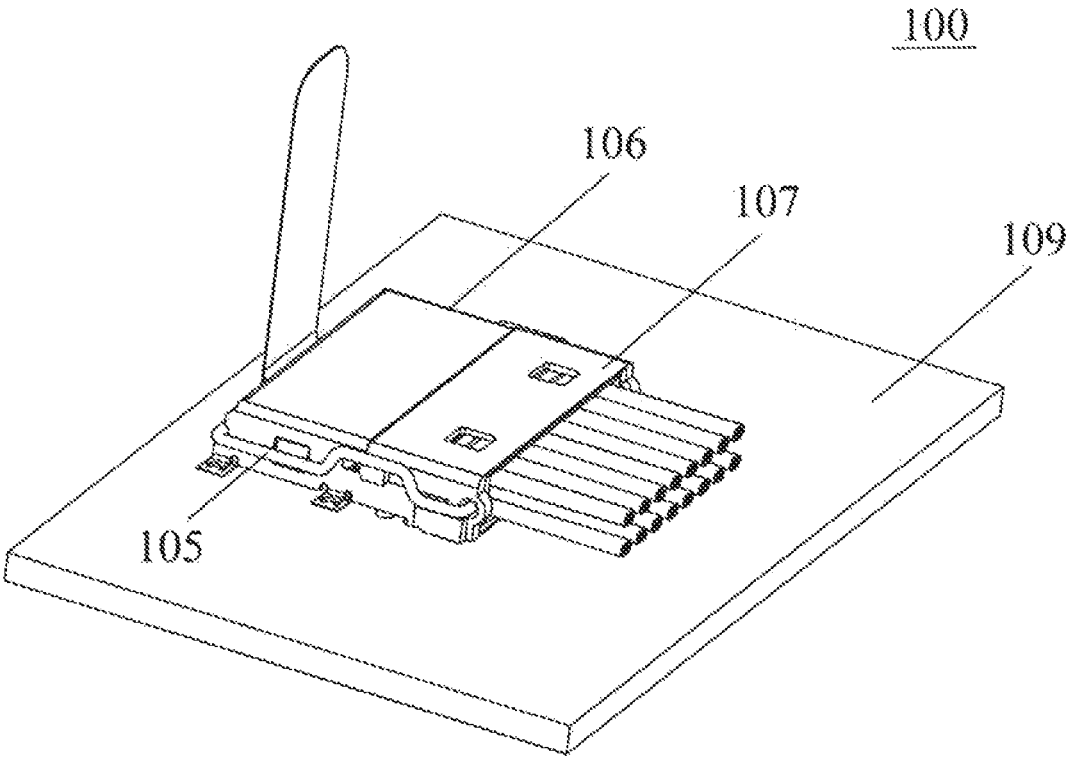
FIG. 2 is a perspective view of the electrical connector assembly of the present disclosure in a use state.

FIG. 2 is a perspective view showing the electrical connector assembly 100 of the present disclosure in a use state. As shown in FIG. 2, when using, the wire end connector 107 is aligned with the board end connector 106 and inserted into the board end connector 106, and the lockable snap 105 is pressed after insertion, such that the wire end connector 107 and the board end connector 106 can be tightly combined.

Figure 3:
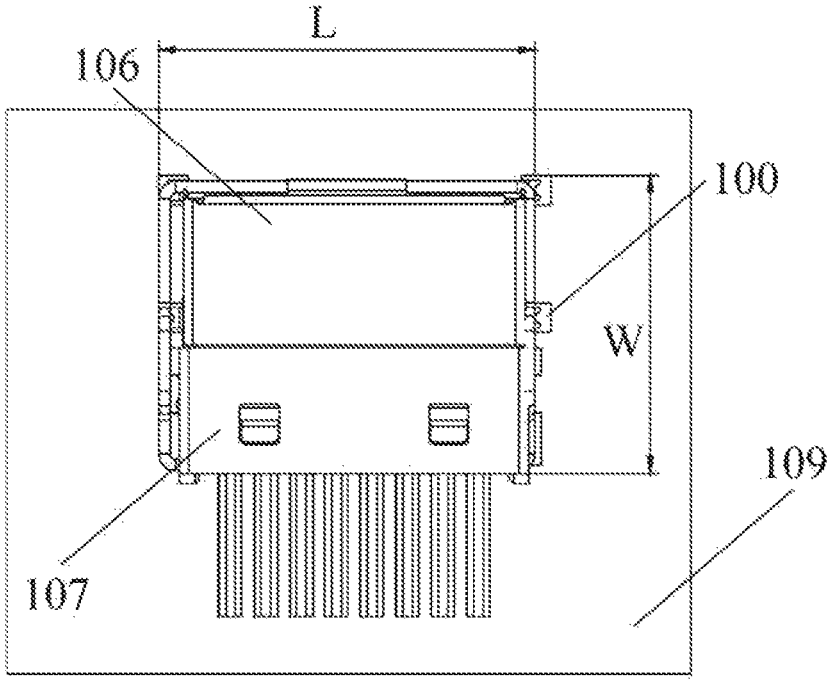
FIG. 3 is a schematic top view of the electrical connector assembly of the present disclosure.

FIG. 3 is a schematic top view of the electrical connector assembly 100 of the present disclosure. As shown in FIG. 3, the electrical connector assembly 100 of the present disclosure has a body portion of a length L, preferably 18-20 mm, and a width W, preferably 13-15 mm, after the wire end connector 107 is coupled to the board end connector 106.

Figure 4:
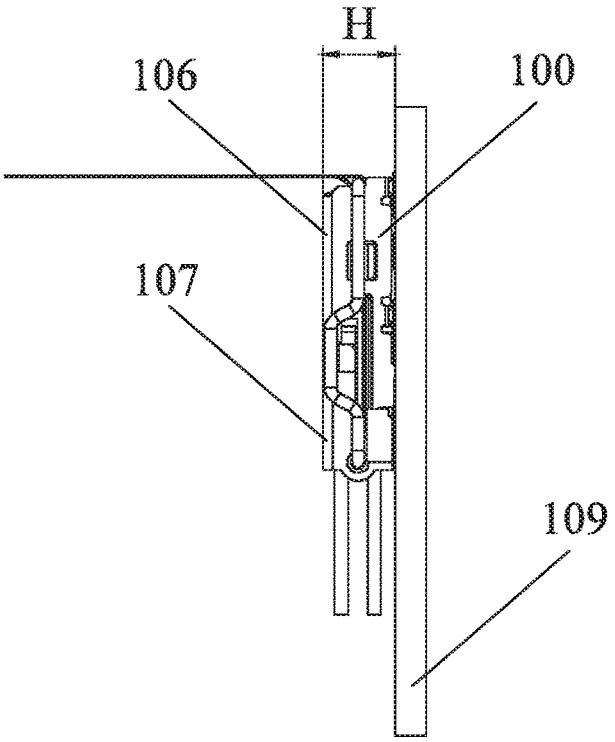
FIG. 4 is a schematic side view of the electrical connector assembly of the present disclosure.

FIG. 4 is a schematic side view of the electrical connector assembly 100 of the present disclosure. As shown in FIG. 4, the electrical connector assembly 100 of the present disclosure has a body portion of a thickness H less than 3.7 mm, after the wire end connector 107 is coupled to the board end connector 106.

Figure 5:
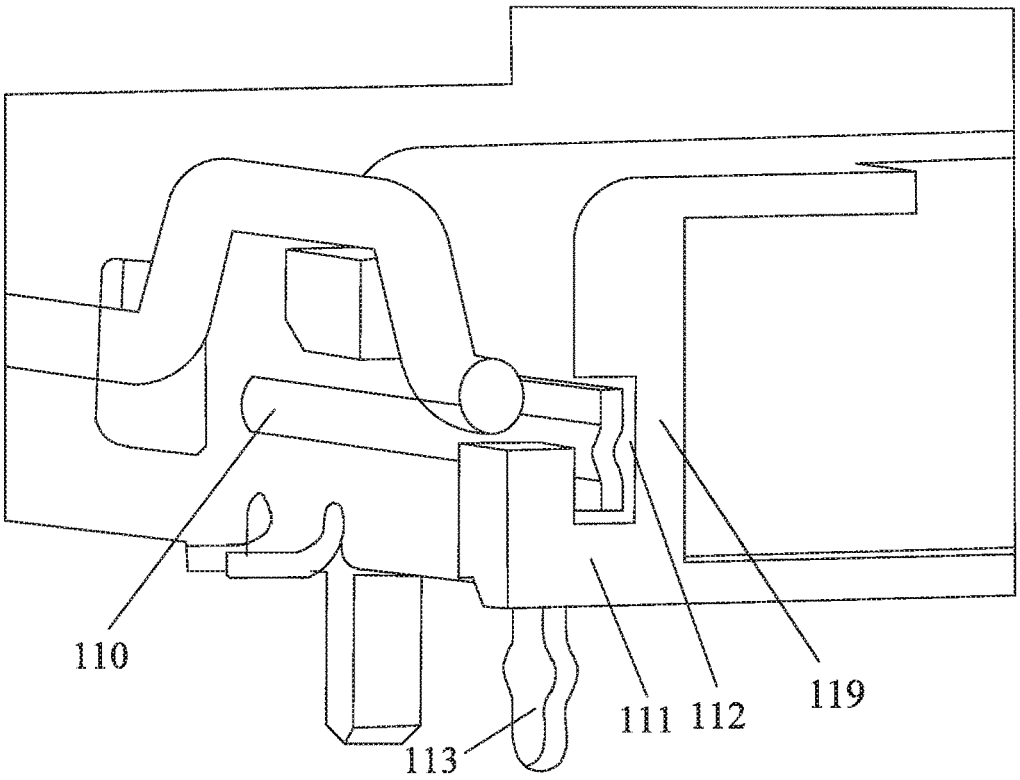
FIG. 5 is an enlarged schematic view of the connected portions of the electrical connector assembly of the present disclosure.

FIG. 5 is an enlarged schematic view of the connected portions of the electrical connector assembly 100 of the present disclosure. As shown in FIG. 5, both sides of the board end connector shell 101 are provided with two guide pieces 110 extending outwards from the board end connector 106, and the guide pieces 110 are integrally formed with the board end connector shell 101. Both sides of the wire end case 103 have at least one guide projection 111 extending outward, and the guide projection 111 is integrally formed with the wire end case 103. The wire end case 103 includes a main portion 119. The guide projections 111 extend sidewardly from the main portion 119 for mating with the corresponding guide pieces 110. Both side surfaces of the wire end case 103 have guide slots 112 recessed toward each other. The guide projection 111 is disposed at an edge of the guide slot 112, and the guide projection 111 surrounds at least a portion of the guide slot 112.

When inserting the wire end connector 107 into the board end connector 106, the wire end connector 107 should be inserted into the board end connector 106 after aligning the two guide pieces 110 of the board end connector 106 with the guide slots 112 of the wire end connector 107. During the plugging process, the guide pieces 110, the guide projection 111 and the guide slots 112 are matched with each other, to provide a plugging alignment mechanism for the wire end connector 107 and the board end connector 106, and prevent improper plugging in the wrong direction.

When the wire end connector 107 is inserted into the board end connector 106, the guide piece 110 is inserted into the guide slot 112, such that the guide piece 110 is disposed between the wire end case 103 and the guide projection 111, the guide projection 111 located on both sides of the guide piece 110 abuts against the guide piece 110, so it is possible to prevent the wire end connector 107 from applying an improper force in a direction other than the abutting direction due to the wire bending, and to reduce the damage when the board end connector 106 is butt jointed with the wire end connector 107.

In addition, a welding foot 113 is disposed at one end of the guide piece 110, and the welding foot 113 is formed by the extension of the guide piece 110 and is integrally formed with the guide piece 110. The welding foot 113 can also be extended from the board end connector shell 101 and disposed front than the guide piece 110 along a rear-to-front direction away from the board end connector body 102. The welding foot 113 is inserted to the printed circuit board 109 and can serve to fix the guide piece 110 to enhance the fixing strength of the guide piece 110. The welding foot 113 can be directly fixed to the printed circuit board 109 or be fixed to the printed circuit board 109 via a soldering or welding material.

Figure 6:
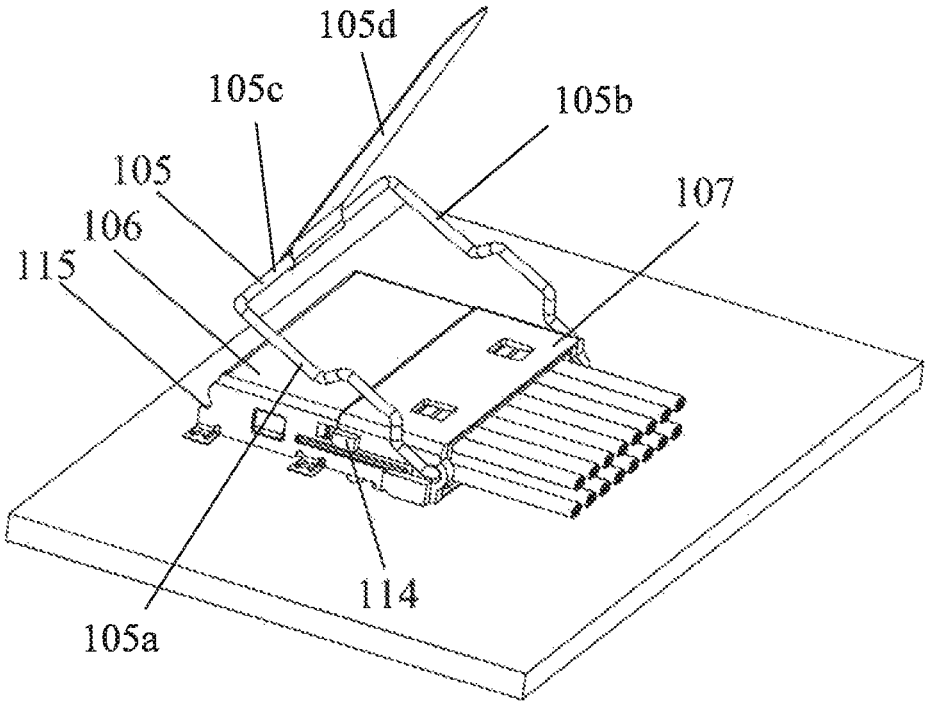
FIG. 6 is a partial schematic view of the lockable snap portion of the electrical connector assembly of the present disclosure.

FIG. 6 is a schematic view of the lockable snap portion of the electrical connector assembly 100 of the present disclosure. The wire end case 103 is provided with snap protrusions 114 at both sides of the outside of the wire end case 103, and the rear end of the board end connector shell 101 is provided with a slot 115. After the wire end connector 107 is inserted into the board end connector 106, the lockable snap 105 is pressed such that the lockable snap 105 is snapped into the slot 115, the snap protrusion 114 is abutted against the lockable snap 105, and the guide piece 110 is accommodated in the guide slot 112. Because the guide piece 110 fastens the wire end case 103 of the wire end connector 107, the wire end connector 107 may lower the displacement in the direction of the vertical butt joint, in which the guide projection 111 and the snap protrusion 114 are disposed on both sides of the guide piece 110. Due to the design of disposing the guide projection 111 and the snap protrusion 114 on both sides of the guide piece 110, it is possible to prevent the movement of the wire end connector 107 caused by the excessive bending of the wire on the side of the wire end connector 107 and also prevent the electrical connector assembly 100 from being warped upward thereby resulting in damage.

Figure 7:
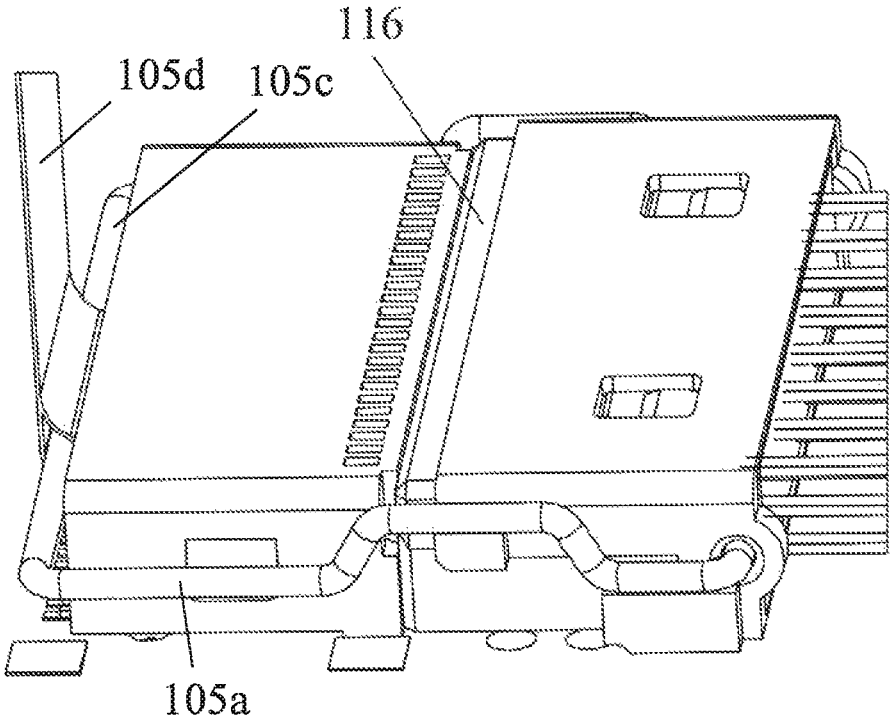
FIG. 7 is an enlarged schematic view of the engagement portion of the electrical connector assembly of the present disclosure.

FIG. 7 is an enlarged schematic view of the engagement portion of the electrical connector assembly 100 of the present disclosure. As shown in FIG. 7, a step 116 is disposed on a portion of the upper surface of the wire end case 103, which is combined with the board end connector 106, such that after the wire end connector 107 is combined with the board end connector 106, a portion of the wire end case 103 is embedded in the board end connector shell 101 to form an overlapping portion, which can prevent the peripheral circuit or device from interfering with the electrical connector assembly 100. In other words, the board end connector shell 101 covers a portion of the wire end case 103 along a direction perpendicular to the printed circuit board 109.

The lockable snap 105 is movable between a first position (see FIG. 6) where the board end connector 106 and the wire end connector 107 are in an unlocking status and a second position (see FIG. 2) where the board end connector 106 and the wire end connector 107 are in a locking status. In the illustrated embodiment of the present disclosure, the lockable snap 105 is pivotal between the first position and the second position. Referring to FIGS. 6 and 7, the lockable snap 105 includes a first arm rod 105*a*, a second arm rod 105*b* and an end rod 105*c* connecting the first arm rod 105*a* and the second arm rod 105*b*. The first arm rod 105*a* and the second arm rod 105*b* are pivotally mounted to two opposite sides of the wire end connector 107, respectively. Furthermore, the lockable snap 105 includes a loosen strap 105*d* which is mounted to the end rod 105*c*. The loosen strap 105*d* is adapted for external force to apply in order to unlock the board end connector 106 and the wire end connector 107 by driving the lockable snap 105 from the second position to the first position.

Figure 8:
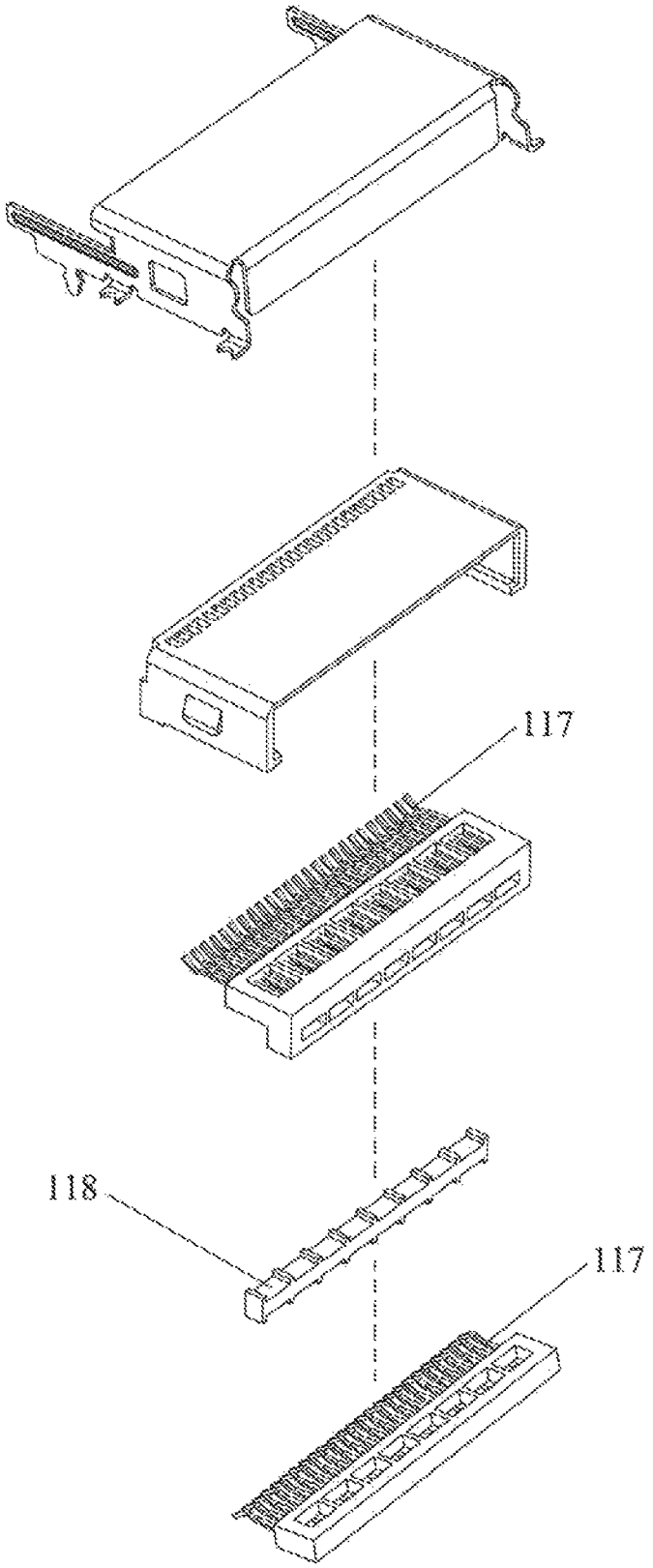
FIG. 8 is an exploded view of the board end connector of the present disclosure.

FIG. 8 is an exploded view of the board end connector 106 of the present disclosure. As shown in FIG. 8, the board end connector 106 includes an upper layer and a lower layer of terminals 117 with a conductive plastic 118 disposed therebetween for optimizing the signal integrity resonance of the electrical connector assembly 100.

Figure 9:
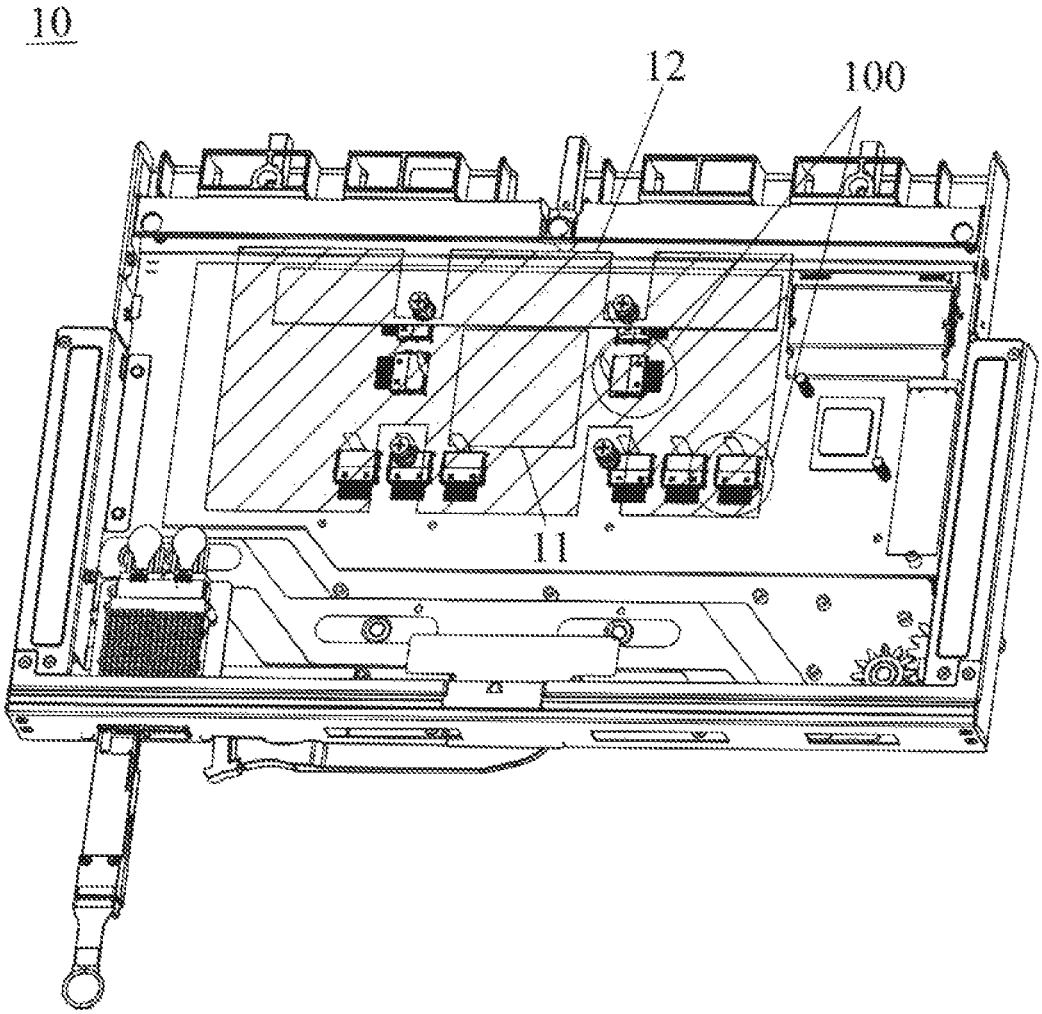
FIG. 9 is a schematic diagram of a system using the electrical connector assembly of the present disclosure.

FIG. 9 is a schematic diagram of a system using the electrical connector assembly 100 of the present disclosure. As shown in FIG. 9, the system 10 of the present disclosure includes a chip 11, a heat dissipation module 12, and the electrical connector assembly 100. As shown, the electrical connector assembly 100 is disposed below the heat dissipation module 12 and is disposed at a side of the chip 11. Therefore, the space below the heat dissipation module 12 can be fully utilized, the space of the printed circuit board is utilized to the maximum extent, and the problem that the CPU occupies the space due to the increased size of the heat dissipation module is solved.

Figure 10:
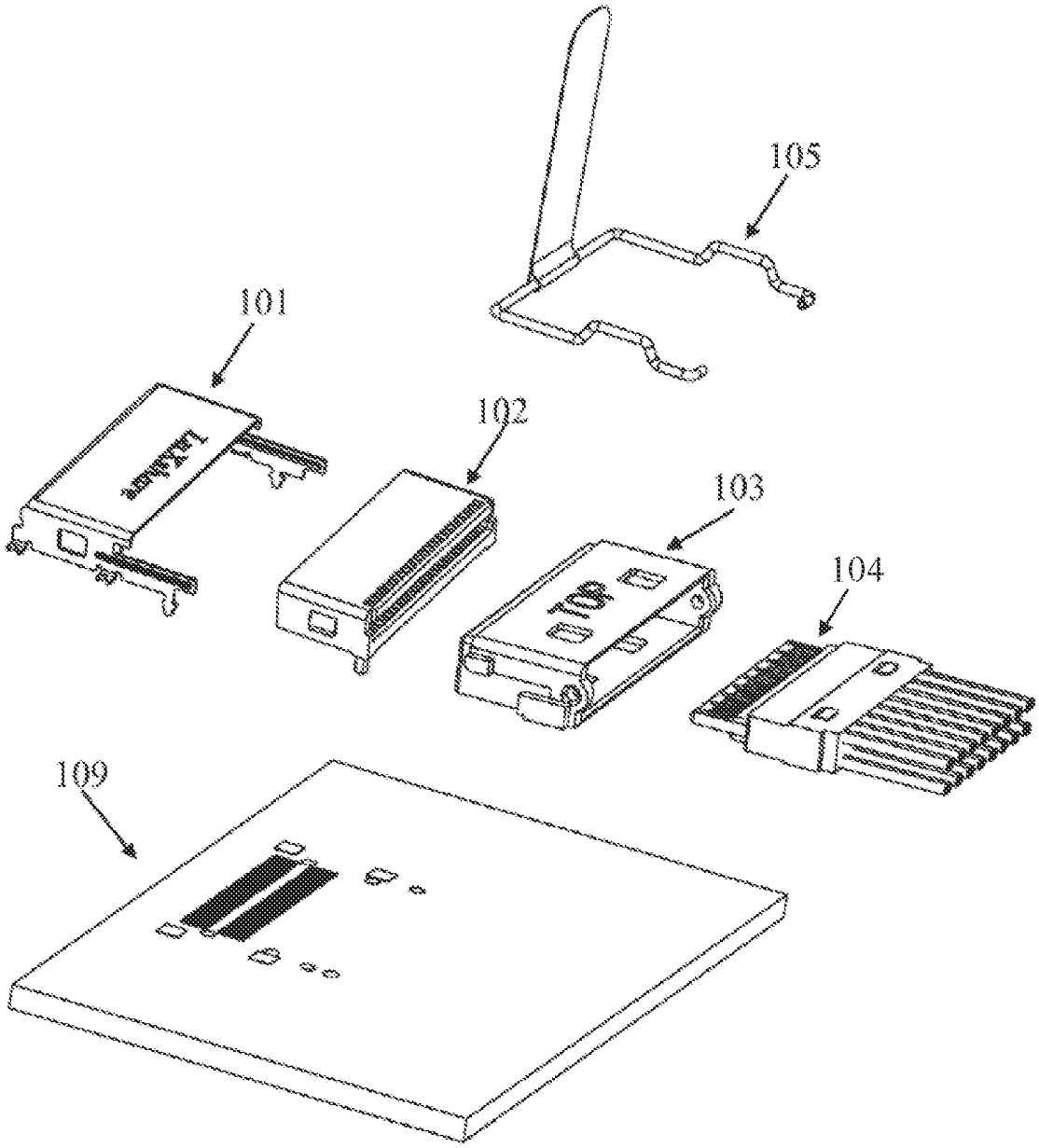
FIG. 10 is an exploded view of the electrical connector assembly of the present disclosure.

FIG. 10 is an exploded view of the electrical connector assembly 100 of the present disclosure. Its specific structure has been explained and the same contents will not be repeated.

The present disclosure may be embodied in other forms, various changes and modifications may be made by one skilled in the art without departing from the spirit or essence of the invention, and the corresponding changes and modifications will fall into the scope of the invention as defined by the appended claims.

What is claimed is:

1. An electrical connector assembly, comprising:

a first connector comprising a first connector shell and a first connector body arranged in the first connector shell; and a second connector comprising a second case and a tongue plate; wherein one of the first connector and the second connector is provided with at least one guide piece, and a remaining one of the first connector and the second connector is provided with at least one guide slot, the first connector and the second connector are guided to mated with each other via the at least one guide piece being received in the at least one guide slot;

the at least one guide slot has an opening to receive the at least one guide piece, and the first connector comprises at least one welding foot extended from the first connector shell and adapted for being mounted to a printed circuit board;

wherein one of the first connector and the second connector comprises a lockable snap pivotal between a first position where the first connector and the second connector are in an unlocking status, and a second position where the first connector and the second connector are in a locking status;

wherein the lockable snap comprises a first arm rod, a second arm rod and an end rod connecting the first arm rod and the second arm rod; the first arm rod and the second arm rod are pivotally mounted to two opposite sides of one of the first connector and the second connector, respectively;

wherein the lockable snap comprises a loosen strap which is mounted to the end rod, the loosen strap is adapted for an external force to apply in order to unlock the first connector and the second connector by driving the lockable snap from the second position to the first position;

wherein the remaining one of the first connector and the second connector defines a slot in which the lockable snap is snapped at the second position.

2. The electrical connector assembly of claim 1, wherein the at least one guide piece is provided on the first connector shell.

3. The electrical connector assembly of claim 2, wherein the lockable snap is provided on the second connector.

4. The electrical connector assembly of claim 3, wherein the second connector is provided with at least one snap protrusion to abut against the lockable snap at the second position.

5. The electrical connector assembly of claim 3, wherein the second connector is provided with two snap protrusions at opposite sides thereof, one of the two snap protrusions abuts against the first arm rod at the second position, and another one of the two snap protrusions abuts against the second arm rod at the second position.

6. The electrical connector assembly of claim 1, wherein the at least one guide piece comprises two guide pieces which are arranged on both sides of the tongue plate, respectively.

7. The electrical connector assembly of claim 1, wherein the at least one welding foot is disposed at one end of the at least one guide piece.

8. The electrical connector assembly of claim 1, wherein the second case comprises a main portion and at least one guide projection extending from the main portion for mating with the at least one guide piece; and wherein the at least one guide piece is disposed between the at least one guide projection and the main portion of the second case.

9. The electrical connector assembly of claim 1, wherein the first connector shell and the second case on the printed circuit board each has a height less than 3.7 mm.

10. The electrical connector assembly of claim 9, wherein the first connector shell covers a portion of the second case along a direction perpendicular to the printed circuit board.

11. The electrical connector assembly of claim 9, wherein the electrical connector assembly is adapted for being arranged on the printed circuit board and located below a heat sink of a chip.

12. The electrical connector assembly of claim 1, wherein the first connector is a board end connector and the second connector is a wire end connector for mating with the board end connector.

13. The electrical connector assembly of claim 1, wherein the at least one guide piece is extended from one of the first connector shell and the second case;

and wherein the at least one guide slot is provided on the remaining one of the first connector shell and the second case.

14. An electrical connector assembly, comprising:

a first connector comprising a first connector shell and a first connector body arranged in the first connector shell; and a second connector comprising a second case and a tongue plate;

wherein at least one guide piece is extended from one of the first connector shell and the second case, and a remaining one of the first connector shell and the second case is provided with at least one guide slot, the first connector and the second connector are guided to mated with each other via the at least one guide piece being received in the at least one guide slot;

wherein the at least one guide slot has an opening to receive the at least one guide piece, and the first connector comprises at least one welding foot extended from the first connector shell and adapted for being mounted to a printed circuit board; and wherein the at least one welding foot is disposed adjacent to the at least one guide piece.

15. The electrical connector assembly of claim 14, wherein the second connector comprises a loosen strap adapted for an external force to apply in order to unlock the second connector and the first connector.

16. The electrical connector assembly of claim 15, wherein the second case is provided with a lockable snap to be buckled with the first connector shell.

17. The electrical connector assembly of claim 14, wherein one of the first connector and the second connector comprises a lockable snap pivotal between a first position where the first connector and the second connector are in an unlocking status, and a second position where the first connector and the second connector are in a locking status;

wherein the lockable snap comprises a first arm rod, a second arm rod and an end rod connecting the first arm rod and the second arm rod; the first arm rod and the second arm rod are pivotally mounted to two opposite sides of one of the first connector and the second connector, respectively.

18. The electrical connector assembly of claim 17, wherein the lockable snap comprises a loosen strap which is mounted to the end rod, the loosen strap is adapted for an external force to apply in order to unlock the first connector and the second connector by driving the lockable snap from the second position to the first position;

wherein the remaining one of the first connector and the second connector defines a slot in which the lockable snap is snapped at the second position.

19. The electrical connector assembly of claim 17, wherein the second connector is provided with two snap protrusions at opposite sides thereof, one of the two snap protrusions abuts against the first arm rod at the second position, and another one of the two snap protrusions abuts against the second arm rod at the second position.

20. An electrical connector for connecting at least one wire to a mating connector, the electrical connector comprising:

a wire end case and a tongue plate;

wherein the wire end case comprises a main portion and at least one guide projection for at least one guide piece of the mating connector being disposed between the at least one guide projection and the main portion of the wire end case;

the electrical connector comprises a loosen strap adapted for external force to apply in order to unlock the electrical connector and the mating connector;

the wire end case is provided with a lockable snap configured to be buckled with the mating connector;

the lockable snap is movable between a first position where the electrical connector and the mating connector are in an unlocking status and a second position where the electrical connector and the mating connector are in a locking status;

the lockable snap is pivotal between the first position and the second position, the lockable snap comprises a first arm rod, a second arm rod and an end rod connecting the first arm rod and the second arm rod, and the first arm rod and the second arm rod are pivotally mounted to two opposite sides of the electrical connector, respectively; and wherein the lockable snap comprises the loosen strap which is mounted to the end rod, the loosen strap is adapted for external force to apply in order to unlock the electrical connector and the mating connector by driving the lockable snap from the second position to the first position.

21. The electrical connector of claim 20, wherein the lockable snap is configured to be buckled with a connector shell of the mating connector.

22. The electrical connector of claim 20, wherein the wire end case is provided with at least one guide slot for creating a butt joint with the at least one guide piece of the mating connector, and wherein the at least one guide slot has an opening to receive the at least one guide piece of the mating connector.

23. The electrical connector of claim 20, wherein the wire end case has a height less than 3.7 mm.

24. The electrical connector of claim 23, wherein the mating connector is disposed adjacent to a chip; and wherein the electrical connector and the mating connector are adapted for being arranged on a printed circuit board and located below a heat sink of the chip.

* * * * *